US007225777B2

(12) United States Patent
Barrena et al.

(10) Patent No.: US 7,225,777 B2
(45) Date of Patent: Jun. 5, 2007

(54) INTERNAL COMBUSTION ENGINE COMPRISING A CONNECTING MEANS FOR CONNECTING A FIRST SECTION OF A WIRE HARNESS ON A CYLINDER HEAD HOUSING TO A SECOND SECTION OF THE SAME

(75) Inventors: Oscar Blasco Barrena, Friedrichshafen (DE); Walter Hanning, Detmold (DE); Dietmar Lutze, Fronhofen (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 51 days.

(21) Appl. No.: 10/523,882

(22) PCT Filed: Aug. 6, 2003

(86) PCT No.: PCT/EP03/08674

§ 371 (c)(1),
(2), (4) Date: Aug. 5, 2005

(87) PCT Pub. No.: WO2004/020814

PCT Pub. Date: Mar. 11, 2004

(65) Prior Publication Data

US 2006/0042602 A1 Mar. 2, 2006

(30) Foreign Application Priority Data

Aug. 9, 2002 (DE) ..... 102 36 505

(51) Int. Cl.
*H01T 13/00* (2006.01)
*H01T 13/08* (2006.01)

(52) U.S. Cl. ..... 123/143 C

(58) Field of Classification Search ..... 123/143 C, 123/90.38, 169 PH, 169 PA; 174/24, 27, 174/28, 29, 25 G, 26 G; 439/125, 352, 357
See application file for complete search history.

(56) References Cited

U.S. PATENT DOCUMENTS

| | | | | |
|---|---|---|---|---|
| 4,922,880 | A * | 5/1990 | Seibt et al. | 123/509 |
| 4,950,171 | A * | 8/1990 | Muzslay | 437/76.1 |
| 4,974,798 | A * | 12/1990 | Harding et al. | 248/73 |
| 5,035,637 | A * | 7/1991 | Mathews et al. | 439/271 |
| 5,086,743 | A * | 2/1992 | Hickey | 123/468 |
| 5,142,744 | A * | 9/1992 | Bruning | 24/16 R |
| 5,642,704 | A | 7/1997 | Gogots et al. | |
| 5,878,706 | A * | 3/1999 | Akamatsu | 123/143 C |
| 6,189,511 | B1 | 2/2001 | Dzierzawski et al. | |
| 6,240,903 | B1 * | 6/2001 | Kurozumi | 123/472 |

(Continued)

FOREIGN PATENT DOCUMENTS

DE 19734970 A1 2/1999

*Primary Examiner*—Mahmoud Gimie
(74) *Attorney, Agent, or Firm*—Klaus P. Stoffel; Wolff & Samson PC

(57) ABSTRACT

The invention relates to an internal combustion engine comprising an injector (3) which is arranged in the cylinder head. According to the invention, said internal combustion engine is provided with a connecting means (7) for connecting a first section (4) of the wire harness to a second section (5) of the same. Said connecting means (7) comprises a terminal carrier (8) and a cover (9, 10). Both the terminal carrier (8) and the cover (9, 10) are provided with self-locking means. In this way, a cost-effective connecting means (7) is provided, which can be easily and quickly mounted.

9 Claims, 5 Drawing Sheets

U.S. PATENT DOCUMENTS 6,502,547 B2 * 1/2003 Kennedy et al. ..... 123/399
6,590,162 B1 * 7/2003 Luedicke et al. ..... 174/135
6,688,290 B2 * 2/2004 Zehnal et al. ..... 123/468
6,702,602 B2 * 3/2004 Wu ..... 439/352

* cited by examiner

INTERNAL COMBUSTION ENGINE COMPRISING A CONNECTING MEANS FOR CONNECTING A FIRST SECTION OF A WIRE HARNESS ON A CYLINDER HEAD HOUSING TO A SECOND SECTION OF THE SAME

PRIORITY CLAIM

This is a 35 U.S.C. §371 National Stage of International Application No. PCT/EP2003/008674, filed on Aug. 6, 2003. Priority is claimed on that application and on the following application:

Country: Germany, Application No. 102 36 505.9, Filed: Aug. 9, 2002.

BACKGROUND OF THE INVENTION

The invention pertains to an internal combustion engine with a connecting means for connecting a first section to a second section of a wire harness on a cylinder head housing. The invention further relates to a process for installing such a harness.

In an internal combustion engine, the fuel is injected into the combustion chamber through an injector. An electronic controller transmits the appropriate actuating signals, which determine the switching state of the injector. The signals are transmitted over a wire harness. Because the injector is located inside the cylinder head housing, the wire harness must pass through the cylinder head housing. This pass-through is critical, because the cylinder head housing must be sealed to prevent the leakage of lubricant and fuel into the environment. The engine vibrations also subject the wire harness to mechanical stress at the pass-through point.

EP 0 454 895 B1 describes a pass-through for a wire harness on a cylinder head. The wire harness is embedded in a seal, which is mounted between the cylinder head and the boot. In another embodiment, the individual wires of the wire harness are pushed through bores in the seal. The problem here is that the wire harness can suffer mechanical damage as a result of excessive tightening torque when the boot is attached to the cylinder head.

DE 197 34 970 A1 describes a central plug, which is screwed into the cylinder head housing of the internal combustion engine. The wire harness leading from the electronic controller to the injector consists of a first section and a second section. The first section extends from the electronic controller to a "counterplug". The second section of the wire harness extends through the interior of the cylinder head housing from the central plug to the injector. By means of a seal, the central plug seals the cylinder head so that no lubricant or fuel can leak out. The problem with this plug-bushing concept is that the manufacturing of the parts themselves is expensive and the fabrication of the first section of the wire harness with the counterplug is complicated. Another difficulty is that the service life of a plug-bushing concept (3,000 hours of operation) is much shorter than the service life of a large diesel engine (more than 20,000 hours of operation). The plug-bushing concept therefore cannot be used in large diesel engines.

SUMMARY OF THE INVENTION

The invention is based on the task of providing a connecting means for the interface between the wire harness and the cylinder head housing which is low in cost, easy to install, and leakproof.

According to the invention, the connecting means comprises a terminal carrier and a boot and both the terminal carrier and the boot have means by which they lock themselves in position. In the case of the boot, the self-locking means is realized in the form of a latching ring or a latching lobe. In the case of the terminal carrier, the self-locking means is realized in the form of latching lobes. In the installed state, the terminal carrier is fixed in place on the cylinder head housing by the latching lobes, which grip under the cylinder head housing, which has the effect of sealing off the interior space. Then the boot is fixed in place on the terminal carrier by means of the latching ring or latching lobe. No additional work steps are required to attach the boot to the terminal carrier. Nor is there any need for fastening means such as screws or bores. The latching ring in the boot offers the advantage that the boot, to which a corrugated hose is attached, can be rotated to any angle on the terminal carrier. The connecting means is designed to last for the predicted life of a large diesel engine; that is, the connecting means is designed to withstand the effects of vibration for this period of time.

In one embodiment, it is proposed that the terminal carrier be provided with terminals and covers, each terminal consisting of a compression spring and a conductor strip. The second section of the wire harness is permanently connected to the conductor strip by a process such as soldering or crimping. In addition, the second section of the wire harness is embedded in the material of the terminal carrier. This guarantees both leak-tightness and the ability to withstand vibrations. Each of the individual wires of the first section of the wire harness is held in place between the compression spring and the conductor strip by the elastic force of the compression spring. The advantage of this arrangement is that the counterplug at the end of the first section of the wire harness can be eliminated. The only tool required to attach the first section of the wire harness to the terminal carrier is a screwdriver. In addition, the clamping action of the compression spring guarantees a uniform clamping force even under vibrational loads and thus also a uniform transition resistance between the wires of the first section of the wire harness and the conductor strip. In comparison with a conventional screw terminal connection, there is no need to retighten the screw. It is known that, in a screw connection of this type, the copper will creep and the screw will loosen.

Because the inventive connecting device does not need to be screwed in place, sealed, or aligned, the assembly time required is cut in half by comparison with the plug-bushing concept.

BRIEF DESCRIPTION OF THE DRAWINGS

Preferred exemplary embodiments are illustrated in the drawings, the same components being designated by the same reference numbers.

DETAILED DESCRIPTION OF THE INVENTION

Figure 1:
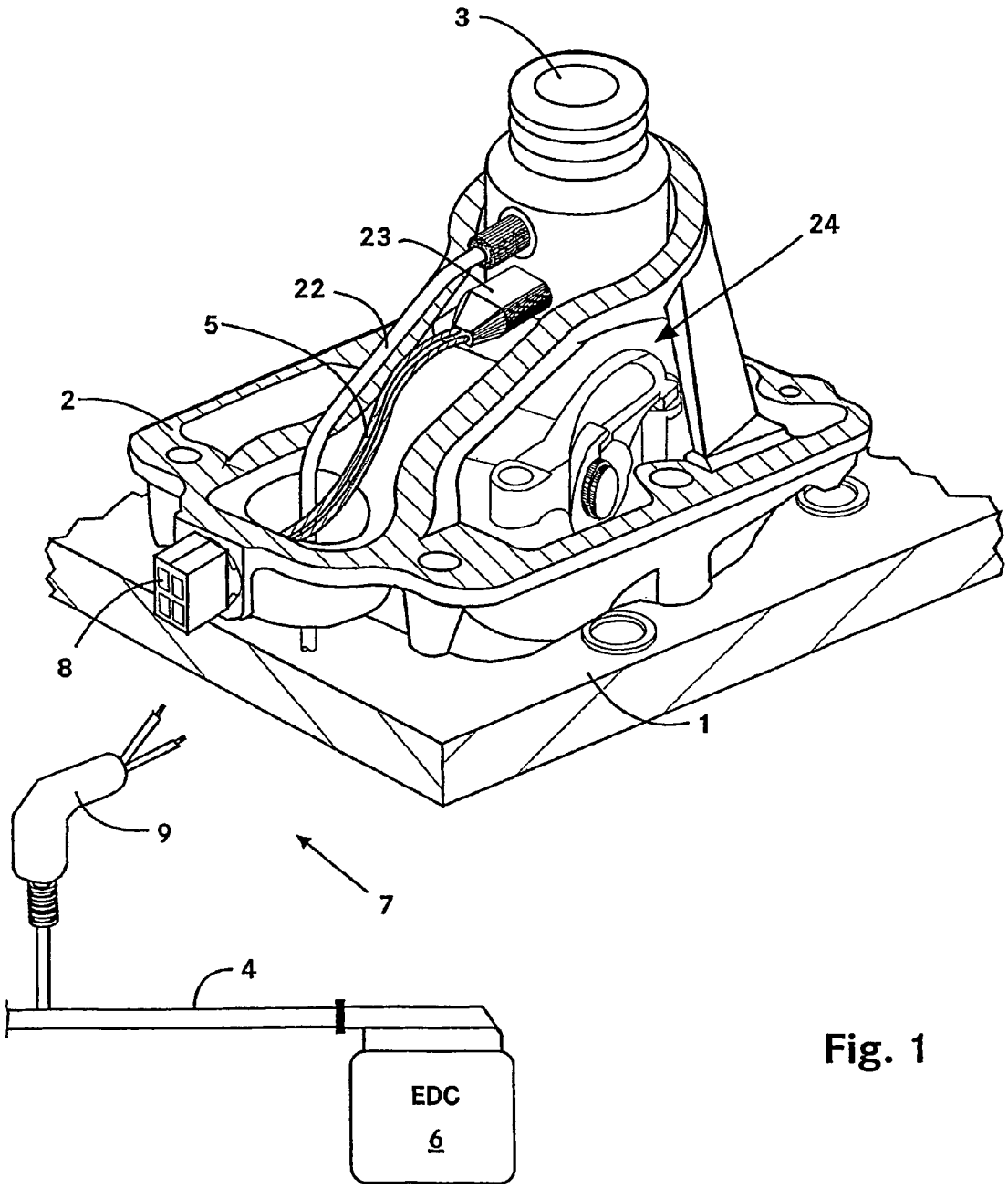
FIG. 1 shows an overall diagram.

FIG. 1 shows the lower half of a cylinder head housing 2 on a crankcase housing 1 of an internal combustion engine. In the cylinder head housing 2 are an injector 3 and a valve driver 24. Through a high-pressure line 22, fuel is supplied under pressure to the injector 3 from, for example, a high-pressure reservoir of a common-rail system. The switching state of the injector 3 is determined by an electronic controller 6 (EDC). The signals are transmitted over a wire harness. This consists of a first section 4 and a second section 5. The first section 4 of the wire harness extends from the electronic controller 6 to the connecting means 7. The connecting means 7 represents the interface between the wire harness and the cylinder head housing. The second section 5 of the wire harness extends through the interior of the cylinder head housing 2 from the connecting means 7 to the injector 3. The end of the second section 5 facing away from the connecting means 7 is connected to the injector 3 by a contact plug 23. In FIG. 1, the connecting means 7 is shown before final assembly. Here a terminal carrier 8 has already been permanently attached to the cylinder head housing 2. The boot 9 is shown on the first section 4 of the wire harness, and the ends of the wires of the first section 4 of the wire harness are shown with their insulation stripped.

Figure 2:
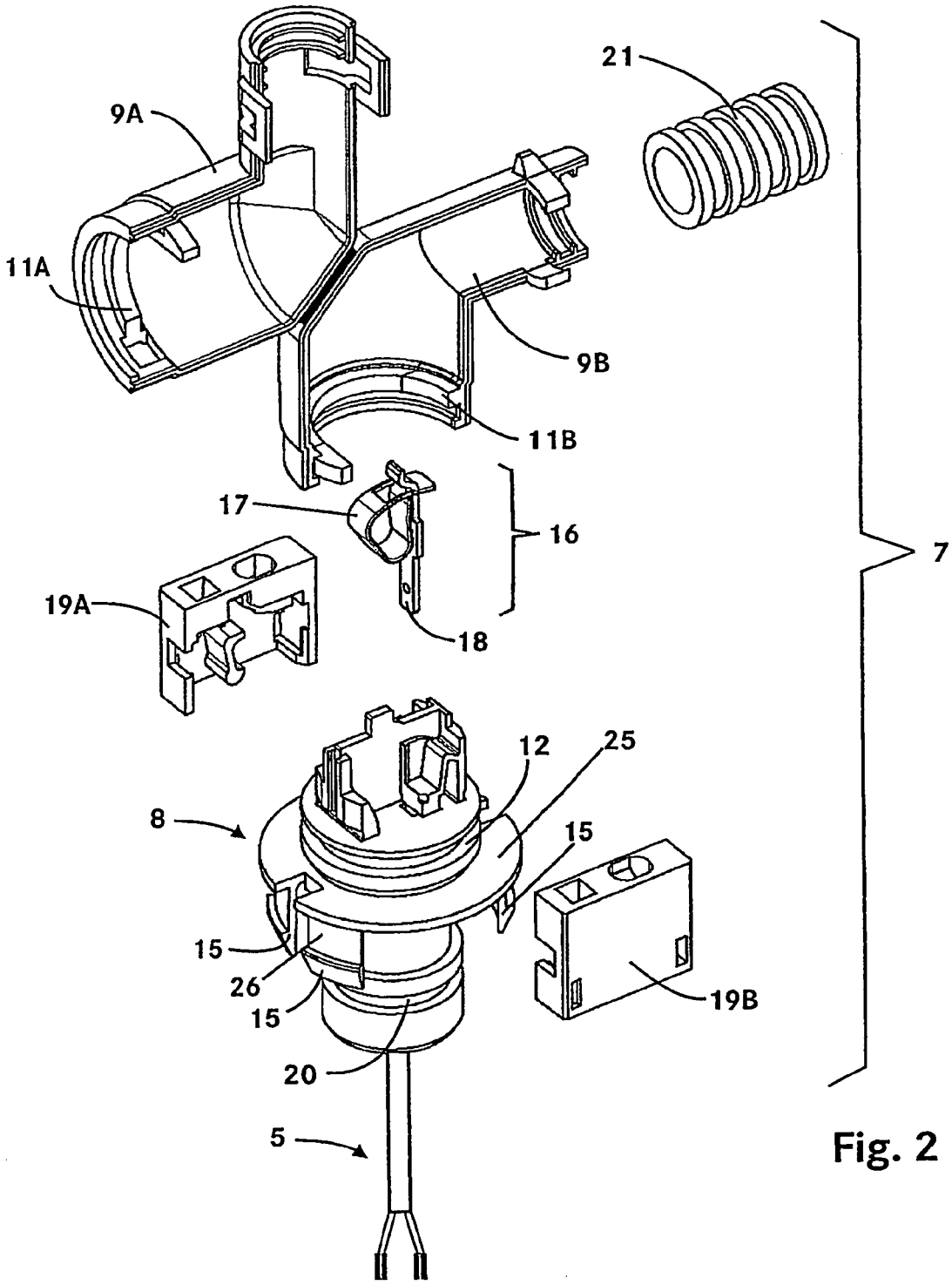
FIG. 2 shows a connecting means in a first embodiment (detailed drawing of the individual parts)
Figure 3:
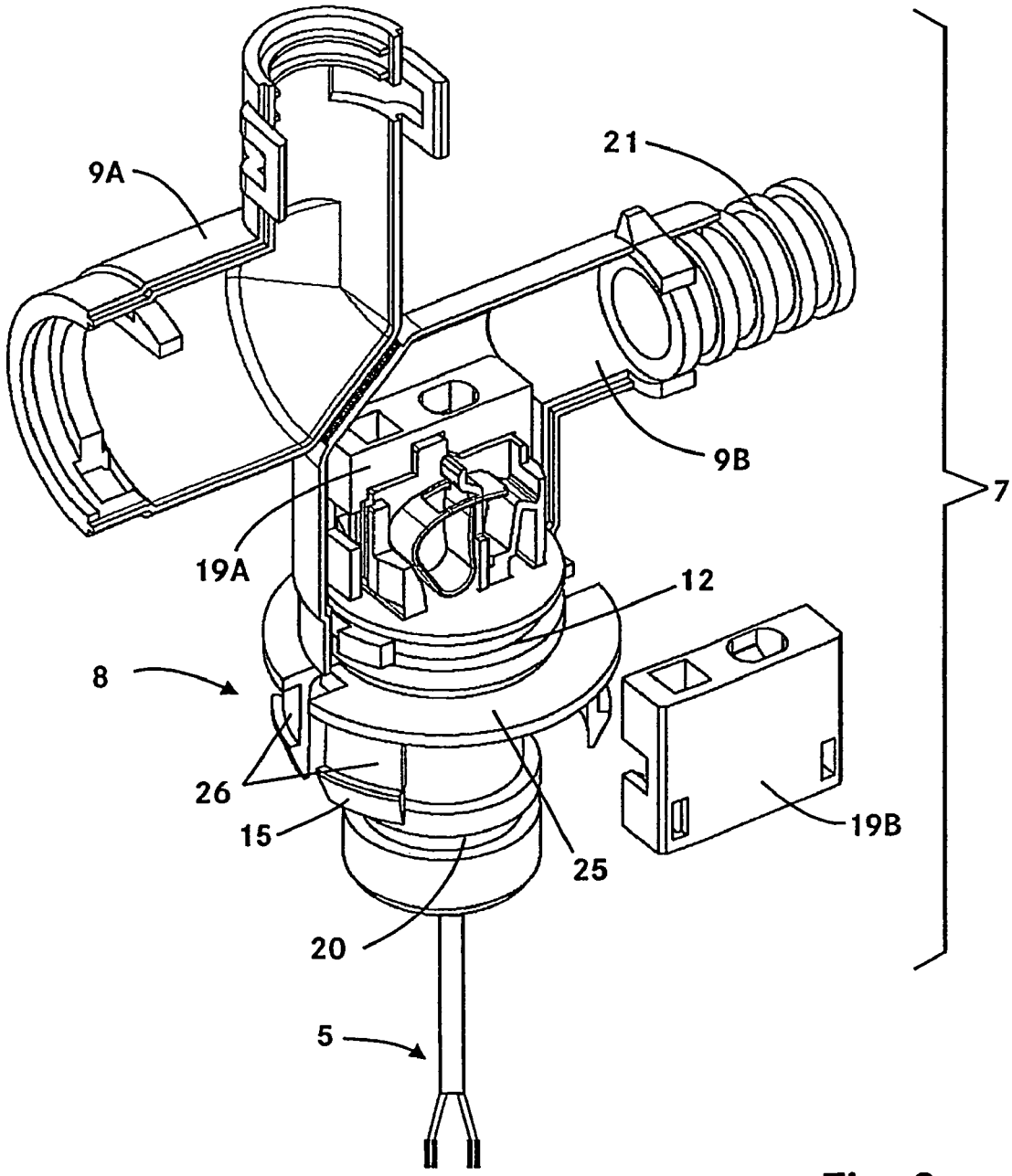
FIG. 3 shows a connecting means in a first embodiment (drawing of the assembled parts)

Reference is made in the following to FIGS. 2 and 3. FIG. 2 shows a detailed view of the individual parts of a first embodiment of the connecting means 7, whereas FIG. 3 shows the parts after they have been assembled. The connecting means 7 consists of the following components: a boot 9, terminals 16, a cover 19, a terminal carrier 8, and a corrugated hose 21. The wires of the wire harness are protected by the corrugated hose 21 from the mechanical damage which could be caused by vibrations.

The boot 9 consists of the J-shaped boot parts 9A and 9B. These are connected to each other by a plastic hinge. Each boot part carries in the interior a section of a latching ring 11, reference numbers 11A and 11B. This latching ring 11 engages in a groove 12 in the terminal carrier 8 (see FIG. 3). Because of this groove-and-ring arrangement, the boot 9 can be rotated 360° on the terminal carrier 8. This offers the advantage that the boot 9, with the corrugated hose 21 attached to it, can assume any desired angle after the connecting means 7 has been attached to the cylinder head. Two terminals 16 are arranged in correspondingly shaped openings in the terminal carrier 8. Each terminal 16 comprises a compression spring 17 and a conductor strip 18. The terminals 16 are supported on correspondingly designed contours on the top of the terminal carrier 8 and on the cover 19. FIG. 2 shows the cover 19, which has a two-part design, reference numbers 19A and 19B. On a base body 25 of the terminal carrier 8 are several webs 26 with latching lobes 15, formed as integral parts of the carrier. By means of these latching lobes 15, the terminal carrier can grip the wall of the cylinder head housing 2 after installation. The latching lobes 15 therefore provide the terminal carrier 8 with a self-locking function. To seal off the terminal carrier 8 from the cylinder head housing 2, a groove 20 is provided to accept an O-ring. The second section 5 of the wire harness is permanently connected to the conductor strip 18 by means of a process such as soldering or crimping. In addition, the second section 5 of the wire harness is embedded in the terminal carrier 8. This guarantees that the opening will be leak-tight and that the connection will be able to withstand vibrations.

Figure 4:
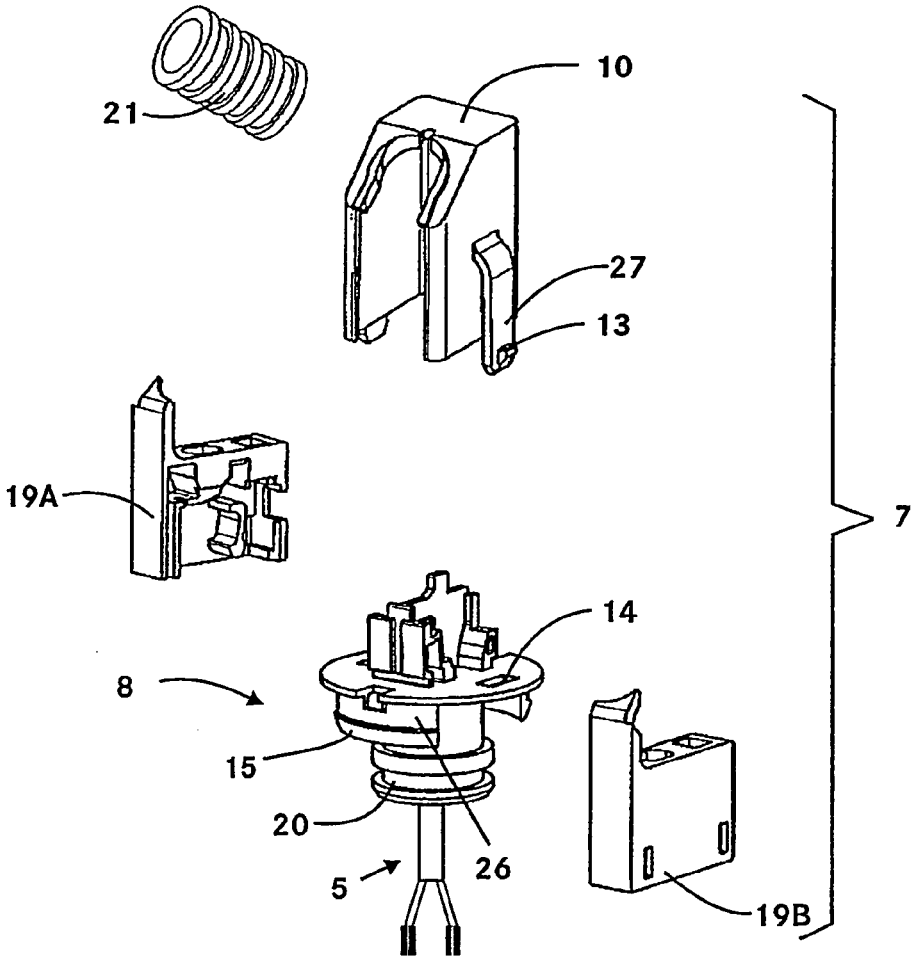
FIG. 4 shows a connecting means in a second embodiment (detailed drawing of the individual parts)
Figure 5:
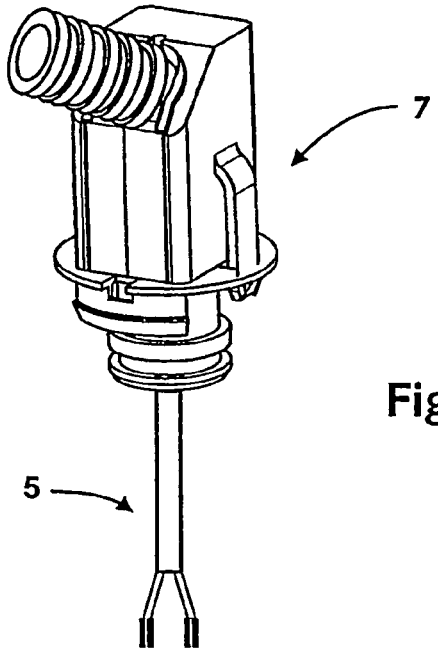
FIG. 5 shows a connecting means in a second embodiment (drawing of the assembled parts)

Reference is made jointly in the following to FIGS. 4 and 5. FIG. 4 shows the individual parts of a second embodiment of the connecting means 7, and FIG. 5 shows the parts after assembly. The first and second embodiments of the connecting means 7 differ with respect to the design of the boot and by the presence of an additional eye on the terminal carrier 8 (FIG. 4). The connecting means 7 consists of the following components: a boot 10, a cover 19, the terminal carrier 8, and the corrugated hose 21. Two webs 27 with latching lobes 13 are provided on the boot 10. By means of these latching lobes 13, the boot 10 is locked in place after installation in the eyes 14 provided in the terminal carrier 8. The rest of the functionalities of the terminal carrier 8, of the lobes 15, and of the cover 19 are the same as those of the embodiment described on the basis of FIGS. 2 and 3.

Figure 6:
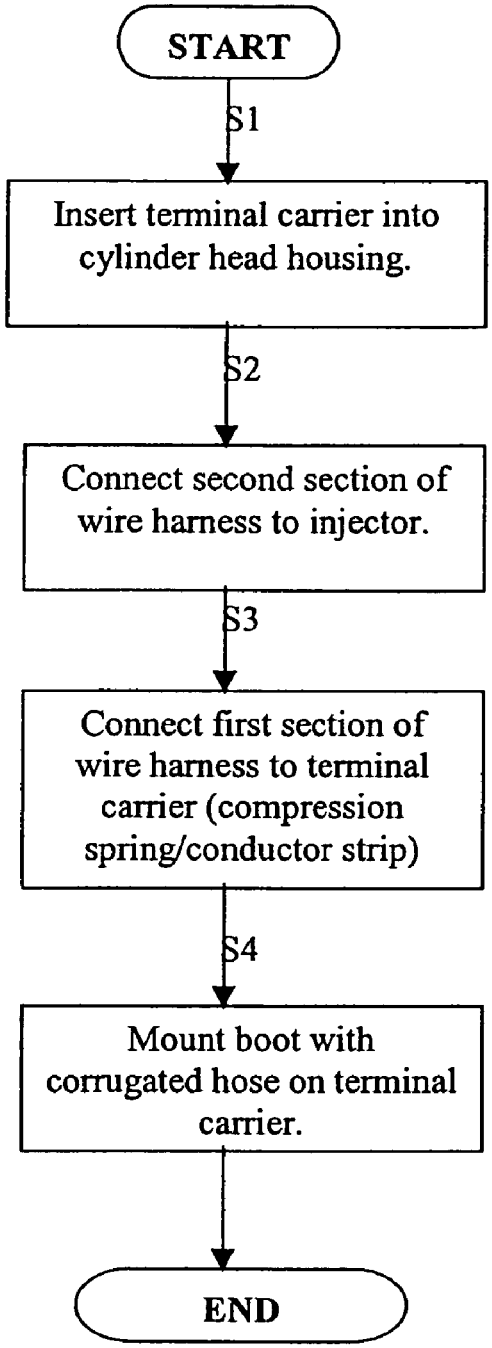
FIG. 6 shows the sequence of installation steps.

FIG. 6 shows the sequence of steps for installing the connecting means 7 in the cylinder head housing 2 of an internal combustion engine. In step S1, the terminal carrier 8 along with the second section 5 of the wire harness is inserted into the cylinder head housing 2, so that the latching lobes 15 grip the housing wall and lock the terminal carrier 8 in place. In step S2, the second section 5 of the wire harness is connected to the injector 3. In step S3, the stripped wires of the first section 4 of the wire harness are connected detachably to the terminal carrier 8 (terminals 16). In the last step S4, the boot 9 or boot 10 along with the corrugated hose 21 is attached to the terminal carrier 8.

The invention claimed is:

1. An internal combustion engine, comprising: at least one cylinder head having a housing; an injector provided in the housing so as to inject fuel; a wire harness for transmitting signals from an electronic controller to the injector, the wire harness including a first section extending from the electronic controller to the cylinder head housing and a second section extending from the cylinder head housing to the injector; and means for connecting the first section to the second section of the wire harness, the connecting means including a terminal carrier and a boot, the terminal carrier having self-locking means formed as a latching lobe that engages on the cylinder head housing so that the terminal carrier is locked in place, the boot having self-locking means that engages on the terminal carrier, wherein the terminal carrier comprises a terminal and a cover, wherein the terminal comprises a compression spring for exerting a clamping force, and a conductor strip, the second section of the wire harness is permanently connected to the conductor strip of the terminal carrier, wherein wires, with insulation removed, of the first section of the wire harness are detachably connected to the terminal carrier by the compression spring and the conductor strip.

2. The internal combustion engine according to claim 1, wherein the terminal carrier has a circumferential groove and the self locking means of the boot is a latching ring that engages in the groove of the terminal carrier.

3. The internal combustion engine according to claim 1, wherein the terminal carrier has eyes and the self-locking means of the boot includes latching lobes that engage in the eyes of the terminal carrier.

4. The internal combustion engine according to claim 1, wherein the terminal carrier has a circumferential groove to accept a sealing ring.

5. The internal combustion engine according to claim 1, and further comprising a corrugated hose between the first section of the wire harness and the boot.

6. The internal combustion engine according to claim 2, wherein the boot consists of two L-shaped boot parts that are connected together by a plastic hinge.

7. A process for installing a connecting means having a terminal carrier and a boot in an internal combustion engine, both the terminal carrier and the boot having self-locking mechanism by which the terminal carrier and the boot lock themselves in place in a cylinder head housing, the process comprising the steps of: fixing the terminal carrier in place on the cylinder head housing by the self-locking mechanism; bringing a second section of a wire harness into contact with an injector; connecting a first section of the wire harness to the terminal carrier; and fixing the boot in place on the terminal carrier by the self-locking mechanism.

8. The process according to claim 7, including permanently connecting the second section of the wire harness to a conductor strip of the terminal carrier.

9. The process according to claim 7, including detachably connecting the first section of the wire harness to the terminal carrier (8).

* * * * *